United States Patent [19]

Swartzlander

[11] Patent Number: 4,649,792

[45] Date of Patent: Mar. 17, 1987

[54] PERCUSSION MALLET FOR A MUSICAL INSTRUMENT

[76] Inventor: Guy J. Swartzlander, 209 S. Parker Ave., Kendallville, Ind. 46755

[21] Appl. No.: 716,334

[22] Filed: Mar. 26, 1985

[51] Int. Cl.[4] ..... G10D 13/00

[52] U.S. Cl. ..... 84/422 S

[58] Field of Search ..... 84/404, 422 S, 422 R

[56] References Cited

U.S. PATENT DOCUMENTS

| | | | |
|---|---|---|---|
| 1,892,886 | 10/1930 | Haight | 84/422 S |
| 2,473,865 | 11/1946 | Dane | 84/404 |
| 2,586,163 | 7/1947 | Heiderich et al. | 84/422 S |
| 3,998,123 | 12/1976 | Hinger | 84/422 S |
| 4,023,461 | 5/1977 | Brandolino | 84/422 S |
| 4,300,438 | 11/1981 | Handal | 84/422 S |
| 4,307,647 | 12/1981 | Christian | 84/404 |
| 4,385,544 | 5/1983 | Heiskell | 84/422 S |
| 4,545,836 | 10/1985 | Lidster | 84/422 S X |

FOREIGN PATENT DOCUMENTS

| | | |
|---|---|---|
| 9852 | of 1906 | United Kingdom . |
| 1020750 | 11/1964 | United Kingdom . |

*Primary Examiner*—Benjamin R. Fuller

*Attorney, Agent, or Firm*—Jeffers, Irish & Hoffman

[57] ABSTRACT

A mallet for a percussion musical instrument which includes a shaft and a head portion. The head portion includes a cylindrical core and an annular sound ridge and a yarn covering encasing the core and sound ridge. Both the core and sound ridge are constructed of laminar layers of sheet material alternating with layers of adhesive tape. The yarn covering fills in the discontinuities between the sound ridge and the core to form a substantially spherical smooth surface for the mallet head.

11 Claims, 9 Drawing Figures

PERCUSSION MALLET FOR A MUSICAL INSTRUMENT

BACKGROUND OF INVENTION

This invention relates to mallets for percussion musical instruments such as drums and more particularly to the construction of mallets for bass drums, timpani, tenor drums and the like and to a method for making such mallets.

In the construction of mallets for musical instruments it is important that the sound produced by the mallets is properly centered or focused. The sound produced by a drum is directional and emanates from the drum head in a cone-shaped sound pattern. Normally in playing a drum the drummer tries to project the sound from the drum toward the audience. It is desirable that the sound be well defined and properly focused and centered so that the audience is able to clearly hear the drum sounds. In the case where the drums are part of a large band it is important that the contribution of the drums to the music produced by the band is pleasing and well balanced. This is particularly true in the case of an entire drum line so that the contribution of each drum should be properly focused and directed toward the audience.

It is also important that the texture of the sound produced by a drum mallet is proper so that the sound is crisp rather than mushy. Lastly, it is important that the impact of sound produced by a drum mallet is proper so as to avoid undesired impact sounds as the mallet head contacts the drum head. Various impact sounds are desired for various applications, situations and musical styles. It is therefore desired to provide a mallet having a head which provides desired impact sound.

Prior art drum mallets generally comprise a shaft including handle and head ends and a mallet head secured to the shaft head end. Mallet heads for bass drum mallets have traditionally been constructed of hard felt shaped in the form of a cylinder. A problem with such mallet heads is that the projection of the sound to the audience is not satisfactory because the sound is not properly centered. Such prior art cylindrical mallet heads are designed to make point or line contact with the drum head surface with the line of contact being in the axial direction of the mallet head. In practice a drummer is generally unable to establish good line contact with the drum head as the angle of inclination of the mallet axis with respect to the plane of the drum head will vary. This is due to the varying lengths of mallets, the manner in which drummers hold their mallets, and the variations in positioning of drum heads with respect to the drummers hands. The mallet head will therefore generally only make point contact with the drum head, thereby losing effectiveness and causing unfocused sound. It is therefore desired to provide a mallet wherein the mallet head will make good line contact with a drum head despite variations in the orientation of the mallet axis with respect to the plane of the drum head, whereby properly focused sound will be produced.

Another problem with prior art mallets is that the mallet heads are formed of felt and tend to become softened or mushy after a certain amount of use. This causes the sound produced by the mallets to lack proper texture and to be muffled which is undesirable. The mallets must therefore be replaced periodically. Since such felt mallets are relatively expensive the need to replace them is especially undesirable.

Some prior art mallets have been constructed of wood or rubber, and have sometimes included a yarn or wool covering. A disadvantage of such mallets has been the cost of manufacturing the mallets, the lack of proper focus of sound produced by the mallets and the short life of the mallets. It is therefore desired to provide a mallet which is relatively inexpensive to manufacture, is durable and produces well centered or focused sound.

Some prior art mallets have included replaceable heads. Such heads must be retained on the mallet shafts by means of special fasteners or retainers which has made the mallets more expensive to manufacture. Furthermore the use of such fasteners has the disadvantage that the mallet heads may work loose due to repeated impact of the mallet heads with the drum heads.

It is therefore desired to provide a mallet of simple construction, which is inexpensive to manufacture, which keeps its shape under repeated impact, and which produces properly centered or focused sound.

SUMMARY OF THE INVENTION

The present invention, in one form thereof, overcomes the disadvantages of the above-described prior art percussion mallets by providing a mallet which includes a sound ridge for properly focusing the sound. The mallet head core and sound ridge are preferably constructed of laminar layers of sheet material.

The present invention in one form thereof comprises a drum mallet including a core which is constructed by winding the head end of the mallet shaft with alternating layers of sheet material such as paper and a suitable adhesive tape such as friction tape. A cylindrical core is thus built up to form the head portion of the mallet. After building up the core, a sound ridge is formed on the mallet head by winding alternating layers of sheet material such as paper and adhesive tape, for instance friction tape, around the head portion to form the sound ridge. The width of the paper strips and tape for forming the sound ridge is smaller than the width of the paper strips and tape for forming the core. The core and sound ridge are then wrapped with yarn or another suitable covering to fill in the discontinuities in the surfaces between the core and sound ridge and the wrapped head is then further wound with yarn or another suitable covering to form a durable, generally spherical mallet head.

By means of the novel construction of the instant invention the mallet head is securely attached to the shaft and is proportioned to properly focus the sound. The size of the mallet head can be easily varied by varying the total number of layers of paper and tape which are used to construct both the core and the sound ridge and by varying the width of the tape and paper strips. Additionally the number of layers of paper which alternate with the tape can be varied whereby the weight of the mallet head may be varied to generate the desired sound characteristics and projection.

The width of the tape for forming the sound ridge may also be varied whereby the mallet head can be constructed to ensure proper and complete contact of the sound ridge with the drum head to generate desired focusing or centering. It should also be understood that the spherical shape of the finished mallet head also contributes to proper focusing of the sound as it ensures good contact of the drum head surface with the mallet head.

It is an advantage of the present invention that the process for making mallets can be adjusted to make a variety of mallets such as bass drum mallets, timpani mallets, tenor drum mallets and the like.

It is a further advantage of the present invention that the process for manufacturing mallets can be practiced either manually or with automated equipment.

Yet another advantage of the present invention is that the materials for manufacturing mallets with the present process are inexpensive whereby very effective yet inexpensive mallet may be constructed according to the method of the instant invention.

A still further advantage of the instant invention is that the mallet heads manufactured with the process will generate properly focused sound by the utilization of a sound ridge.

The present invention, in one form thereof, provides a musical instrument mallet comprising a shaft including a head end and a handle end. A mallet head is secured to the shaft end, the head including a cylindrical core and an annular ridge. The axial dimension of the ridge is less than the axial dimension of the core. A covering encases the head and is adapted to fill in the discontinuities between the core and ridge and to form the head into a smooth body without discontinuities in the outer surface thereof.

The present invention, in one form thereof, further provides a percussion mallet for a musical instrument comprising a shaft having a head end and a handle end. The head comprises a laminar cylindrical core including laminations of sheet material wound cylindrically about the shaft head end.

The present invention, in one form thereof, still further provides a method for manufacturing a musical instrument percussion mallet including a cylindrical shaft having a head end and a handle end. The method comprises winding a first layer of tape around the head end, the tape including adhesive on both surfaces thereof. After this step a first plurality of layers of sheet material is wound around the first tape layer, and a second layer of tape is wound around the first plurality of sheet material. Thereafter a second plurality of layers of sheet material is wound around the second layer of tape. The winding process is continued by alternately winding layers of tape and sheet material until a sufficiently large cylindrical core is formed thereby. The core is then wrapped with a covering to form a smooth substantially spherical mallet head.

It is an object of the present invention to provide a simple construction for a drum mallet and a method for making the same.

It is another object of the present invention to provide an inexpensive drum mallet construction.

It is still another object of the invention to provide a drum mallet which provides properly focused sound.

It is a further object of the present invention to provide a drum mallet for generating sound with proper projection and texture.

It is a yet further object of the present invention to provide a drum mallet constructed of inexpensive materials.

It is yet another object of the present invention to provide a method of making drum mallets which can be practiced manually or with an automated process.

It is a still further object of the present invention to provide a drum mallet having a head which will not become softened upon repeated use.

Yet another object of the present invention is to provide a drum mallet wherein the head is securely retained on the shaft.

BRIEF DESCRIPTION OF THE DRAWINGS

The above mentioned and other features and objects of the invention and the manner of obtaining them will become more apparent and the invention itself will be better understood by reference to the following description of an embodiment of the invention taken in conjunction with the accompanying drawings, wherein.

Corresponding reference characters indicate corresponding parts throughout the several views of the drawings.

The exemplifications set out herein illustrate a preferred embodiment of the invention, in one form thereof, and such exemplifications are not to be construed as limiting the scope of the disclosure or the scope of the invention in any manner.

DETAILED DESCRIPTION OF THE PREFERRED EMBODIMENT

Figure 1:
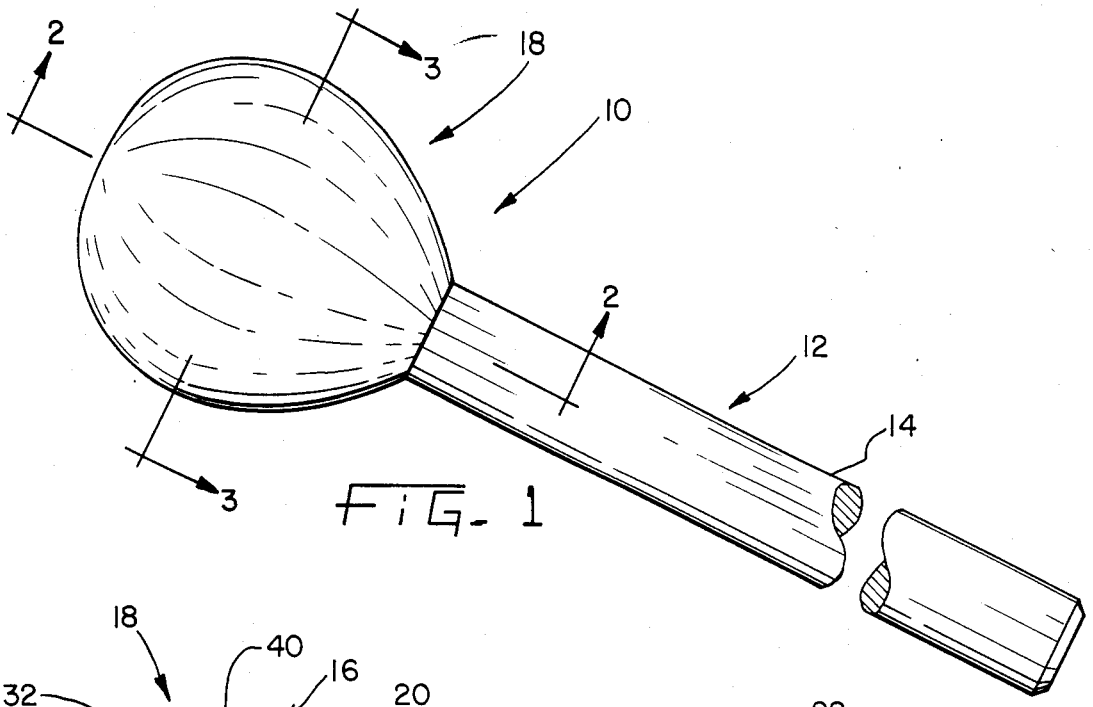
FIG. 1 is an elevational view of a bass drum mallet according to a preferred embodiment of the present invention.
Figure 2:
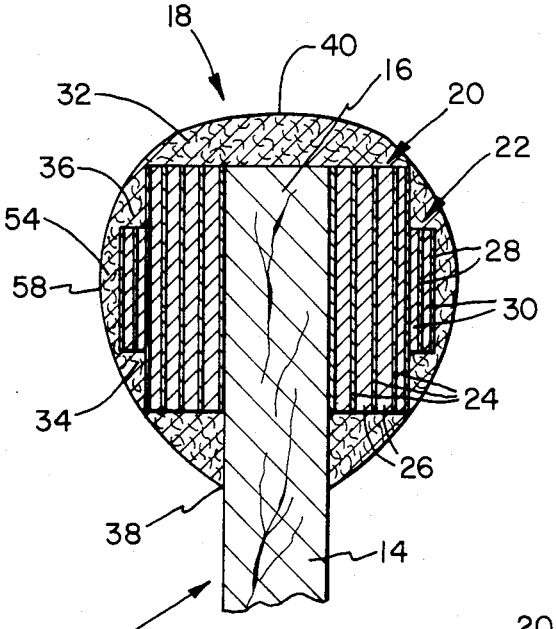
FIG. 2 is a sectional view of the mallet head of FIG. 1 taken along line 2—2.
Figure 3:
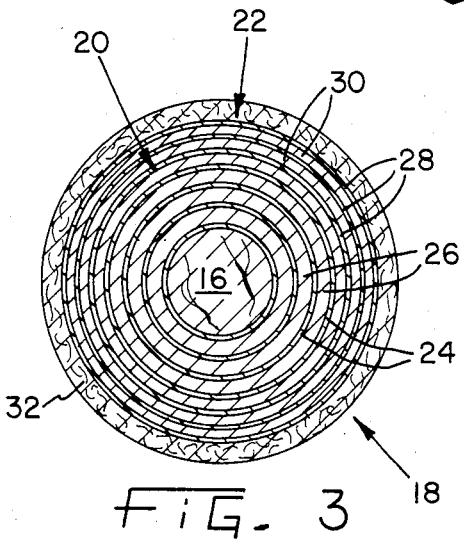
FIG. 3 is a sectional view of the mallet head of FIG. 1 taken along line 3—3.

Referring now to FIGS. 1, 2 and 3 what is shown is a drum mallet 10 including a shaft 12 having a handle end 14 and a head end 16. A head 18 is secured to shaft head end 16. The shaft is preferably constructed of a $\frac{3}{4}$ inch hardwood dowel stock although other materials such as aluminum tubing and the like can also be used. For bass drum mallets the shaft length is preferably as follows:

| Bass drum size | Shaft Length |
|---|---|
| 20 inches | 10.5 inches |
| 22 inches | 11 inches |
| 24 inches | 11.5 inches |
| 26 inches | 12 inches |
| 28 inches | 12.5 inches |
| 30 inches | 13 inches |

By varying the length of the mallet shaft with the size of the drum the drummer will have to reach to hit the center of the drum head, thereby relaxing the back and shoulder muscles and cutting down on cramps and muscle stress. This is especially important since bass drums are normally carried by straps or a carrier which by itself causes muscle tension. Prior art mallets are normally of standard length and are often too long.

The mallet head, as best illustrated in FIGS. 2 and 3, comprises shaft head end 16, core 20, sound ridge 22 and covering 32 for encasing the core and sound ridge.

Head core 20 is formed by winding alternate layers of tape 24 and sheet material 26 around shaft head end 16 to build up cylindrical core 20. The size of cylindrical core 20 is a matter of design choice depending upon the intended use of the mallet. Thus the core for a timpani mallet would have a smaller axial dimension and smaller diameter than the core for a bass drum mallet. After core 20 is completed sound ridge 22 is formed in a similar manner by winding alternating layers of sheet material 30 and tape 28 around core 20.

The axial dimension of sound ridge 22 is clearly illustrated to be less than the axial dimension of core 20. The advantage of this construction is that it causes better impact of the mallet head with the drum head or other percussion instrument, whereby better projection, focusing and centering of the sound is achieved.

Figure 4:
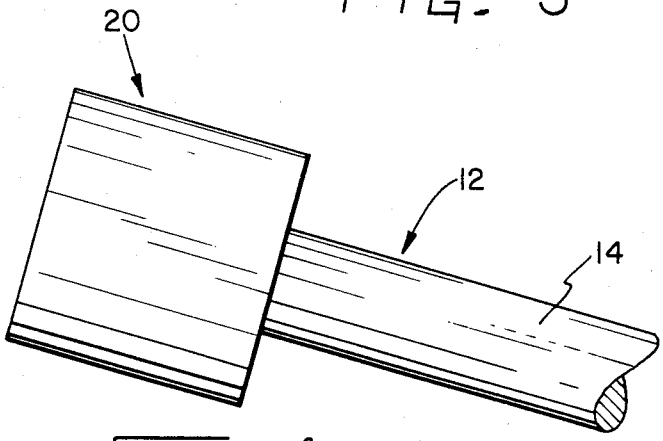
FIG. 4 is an elevational view of a partial assembly of a mallet after formation of the core on the mallet shaft.

Referring further to FIGS. 2, 3 and 4, the sheet material which is used for building up core 20 and sound ridge 22 preferably consists of strips of paper cut to size. For this purpose any suitable paper can be utilized including newspaper.

The tape for constructing the core and sound ridge is preferably a friction tape impregnated with a resin whereby both surfaces of the tape will be sticky and will adhere to the paper. Conventional cloth friction tape may be used for this purpose although other types of tape such as plastic tape having adhesive on both surfaces thereof may also be used.

The weight of the mallet head can be adjusted simply by varying the ratio of the number of layers of paper strips 26 and 30 which alternate with the layers of tape 24 and 28. In a typical construction of a bass drum mallet five strips of newspaper will alternate with one layer of tape. Alternatively, in the construction of other types of mallets such as tenor drum mallets the mallet head should be relatively heavy. Since tape is generally heavier than paper, the paper can be omitted and the core can be formed of tape only.

Instead of manufacturing a laminated sound ridge 22 it is also possible to manufacture the sound ridge from a single piece of material such as plastic or hard rubber whereby the sound ridge can be fitted onto the cylindrical core and attached thereto such as by means of a suitable adhesive.

Figure 5:
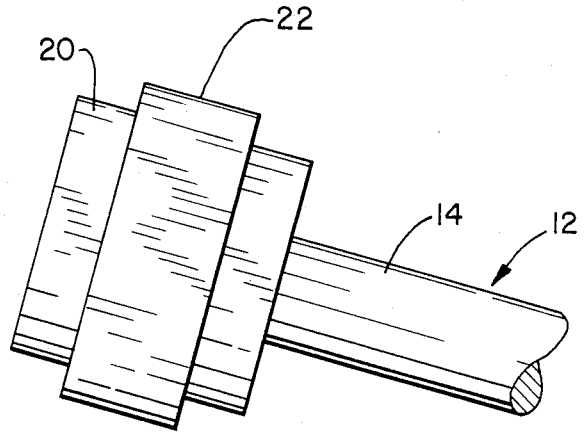
FIG. 5 is an elevational view of a partial assembly of the mallet of FIG. 1 after formation of the core and the sound ridge.
Figure 6:
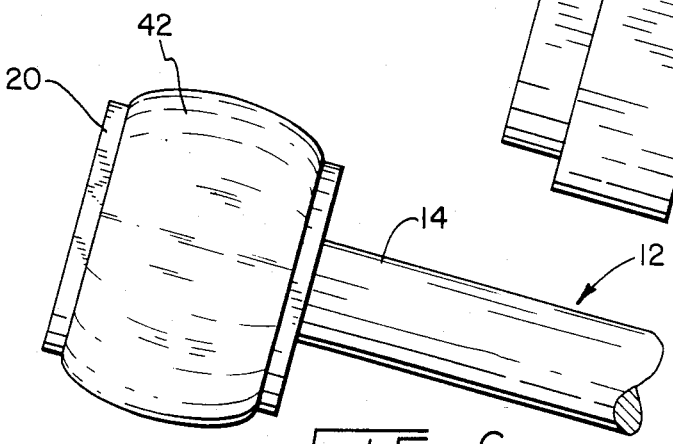
FIG. 6 is an elevational view of a partial assembly of the mallet of FIG. 1 after the wrapping step.

After core 20 and sound ridge 22 have been formed on shaft head end 16, as illustrated in FIGS. 4 and 5, the discontinuities of stepped portions 34 and 36 are filled in and smoothed out by wrapping head 18 with a suitable covering. Generally a yarn covering is used for wrapping the head. However other coverings may be used such as plastic tape, felt, rubber etc. FIG. 6 illustrates a yarn wrapping 42. A small portion of the core is left exposed after completion of the wrapping step. Any suitable yarn may be used although, preferably, the yarn is a strong synthetic material. The yarn must be strong as it must be wrapped quite tightly and should be able to withstand substantial tension.

After wrapping head 18 the head is finished off by winding entire head 18 with yarn to form the finished head. The shape of the head is preferably substantially spherical. The yarn is secured at the top 40 of head 18 by adhesive. Similarly the yarn is secured at base end 38 of head 40 by adhesive.

Figure 9:
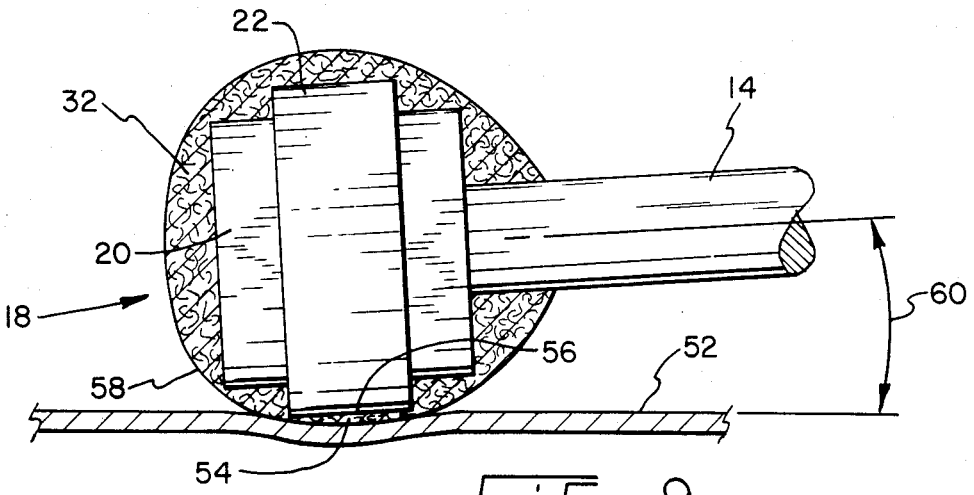
FIG. 9 is a sectional view of a bass drum mallet upon impact with a bass drum head.

As explained hereinabove in operation it is desirable to have substantially complete line contact of the mallet head cylindrical surface with the drum head surface upon impact. Such line contact is difficult to achieve with prior art mallets. The drum head is generally tightly stretched over a frame to form a flat surface. The tension of the drum head can be adjusted to provide the proper pitch of the drum. Upon impact of a mallet head with a flat drum head surface the surface will be momentarily deformed as the mallet causes the drum head to vibrate. By providing a mallet head with a sound ridge having a relatively small axial dimension, it is possible to form a mallet of sufficient weight while insuring substantially complete axial line contact of the mallet head with the drum head surface. This is illustrated in FIG. 9, wherein a sectional view is shown of a bass drum mallet upon impact with a bass drum head. The drum head surface 52 is shown in contact with the outer spherical surface 58 of the mallet. The covering 32 of the mallet head, as more fully described hereinafter, is compacted upon impact. The compacted covering is shown at 54 between the sound ridge 22 and drum head surface 52. Shaft 14 is not parallel to surface 52 but is at an angle with respect to the plane of drum head surface 52 as indicated at 60. This angle will vary from one player to the next. It should be understood that, while drum head surface 52 is normally perfectly flat, the impact of the mallet with the drum head surface will cause some deformation in surface 52 as shown. However, it can be clearly seen that the small axial dimension of sound ridge 22 will aid in causing substantially complete contact of the mallet head sound ridge with drum surface 52 because substantially complete line contact 56 will be made by the entire axial dimension of sound ridge 22 with surface 52. It can also be seen that if sound ridge 22 were to be eliminated, core 20 would not make complete line contact along its axial dimension with drum head surface 52 due to its long axial dimension. Only rarely would a drummer orient shaft 12 of the mallet parallel to the drum head to cause complete and effective line contact of core 20 with drum head surface 52. Therefore by using an annular sound ridge, and ensuring proper contact of the mallet head with the drum head surface upon impact, sound is generated which is properly focused and centered.

The method for making bass drum mallet head 18 is best illustrated in FIGS. 4, 5, and 6 and comprises the following steps. First a shaft 12 is made by cutting a $\frac{3}{4}$ inch length of dowel material to the desired length. A single layer of friction tape 24 is wound around and secured to head end 16 of shaft 12, $\frac{3}{8}$ inches down from the top of shaft 12. A desired number of paper newspaper strips 26, for instance five, are then wound around the single layer of friction tape 24. The ends of the newspaper strips 26 are staggered when they are wound so that each of the ends of the newspaper strips 26 are each secured by the friction tape and so that the wound paper layers will lie smooth and without discontinuities. Newspaper strips 26 are wound very tightly and are secured in place with a second single layer of friction tape 24. A second plurality of newspaper strips 26 is now wound tightly around the second layer of friction tape 24 and are secured in place by means of a third layer of friction tape 24. The process of alternately winding tape and paper layers is repeated until the desired number of laminar layers are built up on shaft head end 16 and core 20 has the desired diameter which for a typical bass drum mallet is approximately $1\frac{3}{4}$ inches.

Sound ridge 22 is now formed in a similar manner as core 20 by winding layers of friction tape 28 alternating with layers of newspaper 30. The axial dimension of the sound ridge is less than the axial dimension of the core to insure that, upon impact, the entire axial length of the sound ridge impacts with the surface of the drum as explained hereinabove. Preferably sound ridge 22 has an axial dimension of ½ to ⅓ of the core axial dimension. The diameter of the sound ridge is established by the desired finished shape of the mallet head and is typically 2⅛ inches for a bass drum mallet. The shape of the finished head is preferably substantially spherical as best illustrated in FIG. 1.

In a typical bass drum mallet the core will have an axial dimension of 1½ inches and the sound ridge will have an axial dimension of ¾ inch.

Sound ridge 22 is now wrapped with yarn. A slip knot is tied in the yarn and is drawn up tightly around shaft 12 at the base of core 20. This secures the inside tail of the yarn. The entire length of yarn is now wrapped very tightly around sound ridge 22 to form a smoothly rounded surface as best illustrated in FIG. 6. The outside tail of the yarn is tied securely around shaft 12 at the base of the core 20. A yarn needle is used to make one loop stitch to secure the outside tail of the yarn.

Entire head 18 is now wound with yarn. A slip knot is tied in the end of the yarn and is drawn up tightly around shaft 12 at the base of core 20 to secure the inside tail. Adhesive is applied to the layers of paper 26 at the top 40 of mallet head 18 and the yarn is wrapped about head 18 in an up and down circular motion. The yarn is wrapped in the adhesive at top 40 of head 18 to secure the yarn and to prevent its unraveling. About three feet of yarn is left unwrapped and is used to stitch the yarn. The yarn is tied off at base 38 of head 18 and the three foot tail is stitched into the crown of the head at the top 40 of mallet head 18 using a loop stitch. After this step the yarn is stitched at base 38 of mallet head 18 by using a loop stitch. The stitch is reversed several times to aid in securing the tail. The excess of the yarn tail is then cut off. Adhesive is then applied to the yarn at base 38 of head 18 so that the yarn will not unwind and will be secured to shaft 12.

Yarn wrapping 32 and winding 42 for encasing head 18 is preferably of minimal thickness. Wrapping 32 and winding 42 are intended to fill in the discontinuities between core 20 and sound ridge 22 and further provides a smooth substantially spherical outer shape for the head. By referring to FIG. 9 it can be seen that upon impact it is preferable to have a minimum thickness of yarn 54 at the outer periphery of sound ridge 22 so that good line contact can be made between sound ridge 22 and drum head surface 52. The yarn will be somewhat compressed between sound ridge 22 and surface 52 as shown at 54 and will therefore not appreciably soften the outer surface of sound ridge 22 or adversely affect the sound texture. The yarn covering is effective in generating the impact sound which would be desired for most applications. It should be noted, as pointed out above, that other coverings such as plastic tape, felt, rubber and the like can be used to generate different impact sounds. However the yarn covering has been found to give the best sound for most applications.

Figure 7:
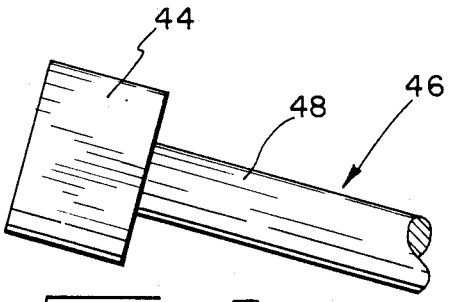
FIG. 7 is an elevational view of a partially assembled tenor drum mallet.
Figure 8:
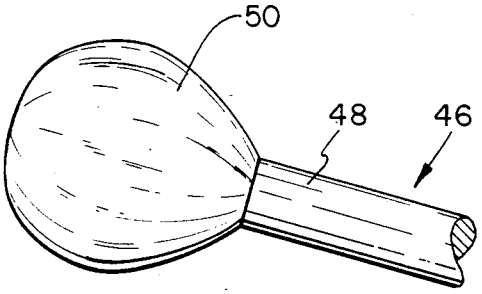
FIG. 8 is an elevational view of a completed tenor drum mallet.

FIGS. 7 and 8 illustrate a tenor drum mallet which has a thinner shaft and a smaller head then the bass drum mallet of FIG. 1–6. This mallet is constructed by using only layers of tape rather than using both paper and tape. No sound ridge is provided for the tenor drum mallet as the head is small enough to achieve good contact with the drum head surface even if shaft 46 is not parallel with respect to the plane of the timpani head surface.

After winding the tape to form core 44 of the tenor drum mallet head 50 is wrapped with yarn to form a substantially spherical surface for head 50 as best illustrated in FIG. 8. Since the tenor drum mallet is constructed of tape only, the tenor drum mallet head will be relatively heavy as is desired. Tenor drum mallets are generally used outside and are therefore heard at a fairly long distance. Therefore louder volume levels are needed. This calls for good sound projection. Tenor drum mallets are therefore made fairly heavy to give good sound projection. As distinguished from this timpani mallets can be constructed according to the instant invention to be light in weight by using more paper layers. Timpani mallets are generally used indoors and can therefore be light in weight since they are heard at close range and sound levels need not be as loud as for tenor drums.

It should be readily appreciated that the instant method of manufacturing mallets allows the mallet heads to be manufactured to have varying weights, sizes and shapes to provide sound with desirable centering, texture and impact. It should also be readily appreciated that the mallets may be manufactured according to the method of the instant invention either manually or with automated equipment.

While this invention has been described as having a preferred design it will be understood that it is capable of further modification. This application is therefore intended to cover any variations, uses or adaptations of the invention following the general principles thereof and including such departure from the present disclosure as come within known or customary practice in the art to which this invention pertains and fall within the limits of the appended claims.

What is claimed is:

1. A musical instrument mallet comprising:

a shaft including a head end and a handle end;

a head secured to said shaft head end, said head including a cylindrical core and an annular ridge, said ridge being concentric with said core and surrounding said core and having an axial dimension less than the axial dimension of said core, said ridge being located intermediate the end surfaces of said core; and a covering encasing said head and adapted to fill in surface discontinuities between said core and ridge to form a smooth body without discontinuities in the outer surface thereof.

2. The mallet according to claim 1 wherein said ridge comprises a laminar structure formed of sheet material.

3. The mallet according to claim 2 wherein said laminar structure comprises a plurality of layers of paper interleaved with a plurality of layers of tape.

4. The mallet according to claim 1 wherein said core comprises a plurality of laminated layers of sheet material.

5. The mallet according to claim 4 wherein said layers each comprise pluralities of sheets of paper alternating with layers of tape.

6. The mallet according to claim 1 wherein said covering comprises yarn wound around said core and ridge.

7. The mallet according to claim 1 wherein said ridge has an axial dimension in the range of one half to one third of the axial dimension of said body.

8. A percussion mallet for a musical instrument comprising:

a shaft having a head end and a handle end;

a head secured to said shaft head end and comprising a laminar cylindrical core including a plurality of layers of paper alternating and interleaved with layers of tape, said layers of paper and tape wound cylindrically about said shaft head end and;

a yarn covering wound about said core to form a smooth substantially sperical body.

9. The mallet according to claim 7 including an annular ridge having an axial dimension in the range of ½ to ⅓ of the axial dimension of said core, said ridge arranged around said core intermediate the end surfaces of said core.

10. The mallet according to claim 9 wherein said ridge comprises layers of sheet material secured in position with layers of tape, said tape having adhesive material on both surfaces thereof.

11. The mallet according to claim 9 wherein said ridge comprises pluralities of layers of paper alternated with layers of resin impregnated adhesive tape.

* * * * *